US010273139B2

(12) United States Patent
Aitken

(10) Patent No.: US 10,273,139 B2
(45) Date of Patent: Apr. 30, 2019

(54) REFUELING ADAPTER

(71) Applicant: Ford Global Technologies, LLC, Dearborn, MI (US)

(72) Inventor: Brian Thomas Aitken, Livonia, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 1391 days.

(21) Appl. No.: 13/756,318

(22) Filed: Jan. 31, 2013

(65) Prior Publication Data

US 2014/0209209 A1 Jul. 31, 2014

(51) Int. Cl.
*B67D 7/02* (2010.01)
*B67D 7/42* (2010.01)

(52) U.S. Cl.
CPC ..... *B67D 7/42* (2013.01)

(58) Field of Classification Search
CPC ..... B60K 15/04; B67C 11/02; B67D 7/42; B67D 7/00; B67D 7/02
USPC ..... 141/297, 301, 331, 332, 333, 334, 350, 141/310, 342, 311 R, 201; 220/86.2, 808, 220/86.1, 368; 239/552, 548, 590.3
See application file for complete search history.

(56) References Cited

U.S. PATENT DOCUMENTS 57,347 A * 8/1866 Lochman ..... B67C 3/2637 141/286
167,548 A * 9/1875 Lilley ..... B67C 11/02 141/333
170,504 A * 11/1875 Amole ..... B65D 51/246 220/212
220,576 A * 10/1879 Chilis ..... B67D 7/0401 141/98
474,036 A * 5/1892 Wood ..... B67C 11/02 141/340
559,905 A * 5/1896 Pike ..... A47J 31/06 210/477
1,134,837 A * 4/1915 Fox ..... B01D 35/28 141/331
1,170,892 A * 2/1916 Graham ..... B01D 17/045 141/331
1,217,732 A * 2/1917 Fedders ..... F28D 1/0358 123/41.27
1,692,039 A * 11/1928 Hinz ..... F24D 19/0082 141/333

(Continued)

FOREIGN PATENT DOCUMENTS

GB 2170121 A 7/1986
JP 2003312277 A 11/2003
JP 2012076754 4/2012

OTHER PUBLICATIONS

Zitkovic M., et al., "Universal Capless Refueling Funnel," U.S. Appl. No. 13/679,587, filed Nov. 16, 2012, 49 pages.

*Primary Examiner* — Jason K Niesz
*Assistant Examiner* — James Hakomaki
(74) *Attorney, Agent, or Firm* — Julia Voutyras; McCoy Russell LLP

(57) ABSTRACT

A refueling adapter is provided. The refueling adapter includes a nozzle section and an inlet section coupled to and positioned upstream of the nozzle section, the inlet section including a restrictor element extending across an inlet section flow passage and an anti-sealing rib coupled to an inlet section housing and axially extending along the inlet section flow passage.

19 Claims, 3 Drawing Sheets

(56) References Cited

U.S. PATENT DOCUMENTS 1,733,261 A * 10/1929 Higby ..... B67C 11/02 141/337
2,200,642 A 5/1940 Shell
2,225,111 A * 12/1940 Higgens ..... B67C 11/02 141/333
2,524,313 A * 10/1950 Gerling ..... B60K 15/04 116/228
3,016,161 A * 1/1962 Peplin ..... B01D 35/023 141/382
3,245,437 A 4/1966 Holz
3,490,501 A 1/1970 Manem et al.
D217,180 S 4/1970 Holland
3,643,707 A 2/1972 Ensign
3,738,399 A * 6/1973 Kuhlman ..... B67D 7/42 137/386
D234,123 S 1/1975 Ragagli
3,967,660 A 7/1976 Russell
4,112,984 A * 9/1978 Guglia ..... B67C 11/02 141/339
D263,715 S 4/1982 Walter
4,347,878 A 9/1982 Schofield
D269,425 S 6/1983 Whitaker, Jr.
4,526,216 A * 7/1985 Lake, Jr. ..... B60K 15/04 137/588
4,529,097 A * 7/1985 Larson ..... B60K 15/04 138/40
4,600,125 A 7/1986 Maynard, Jr.
4,679,698 A * 7/1987 Thorn ..... B67D 7/344 220/86.2
4,706,708 A * 11/1987 Fornuto ..... B60K 15/03519 137/588
4,913,201 A 4/1990 Lucero et al.
5,101,869 A * 4/1992 Myers ..... F16N 31/002 141/297
D340,468 S 10/1993 Pollak et al.
5,389,253 A * 2/1995 Cicconi ..... B01D 29/085 210/248
D383,949 S 9/1997 Lown
5,829,495 A * 11/1998 Corfitsen ..... B60K 15/04 141/348
5,839,489 A * 11/1998 Ganachaud ..... B60K 15/04 141/301
5,979,516 A * 11/1999 Grant ..... F01M 11/0408 141/114
D422,674 S 4/2000 Chrisco et al.
6,083,392 A * 7/2000 Rigney ..... A47J 37/1271 210/451
6,170,535 B1 1/2001 Sadr et al.
6,212,691 B1 * 4/2001 Heberer ..... A47K 11/12 4/144.1
6,415,827 B1 * 7/2002 Harris ..... B60K 15/03519 141/302
D499,180 S 11/2004 Best
7,270,159 B2 9/2007 Burns
7,299,834 B1 * 11/2007 Platt ..... B67C 11/063 141/301
7,540,311 B2 * 6/2009 Quigg ..... B60K 15/04 141/287
7,607,459 B2 10/2009 Treen, Jr.
7,665,492 B2 * 2/2010 Burstein ..... B67C 11/02 141/332
7,721,774 B2 5/2010 Cook et al.
D632,144 S 2/2011 Weisenbach
8,567,456 B1 * 10/2013 Francis ..... B67C 11/02 141/286
8,720,721 B2 * 5/2014 Dutzi et al. ..... 220/86.2
9,365,404 B2 * 6/2016 Zitkovic ..... B67C 11/02
2004/0154696 A1 * 8/2004 Koncelik, Jr. ..... B60R 11/00 141/331
2007/0062110 A1 * 3/2007 Lofboom ..... A01G 27/005 47/48.5
2007/0256755 A1 11/2007 King
2009/0050625 A1 * 2/2009 Fowler ..... F16L 25/009 220/86.2
2010/0288762 A1 * 11/2010 Muto ..... B60K 15/04 220/86.2
2011/0079322 A1 * 4/2011 Beier ..... B60K 15/0406 141/350
2011/0214782 A1 9/2011 McGeary
2012/0125927 A1 * 5/2012 Watson ..... B60K 15/0403 220/86.3
2012/0152865 A1 * 6/2012 Lin ..... 210/808
2012/0267006 A1 * 10/2012 Liao ..... B67C 11/02 141/331

* cited by examiner

REFUELING ADAPTER

FIELD

The present invention relates to a refueling adapter in a fuel delivery system of a vehicle.

BACKGROUND AND SUMMARY

Vehicles having internal combustion engines require periodic refueling to enable continued combustion operation in the engine after periods of vehicle use. Vehicles may be equipped with refueling ports to enable refueling nozzles to be inserted into a refueling conduit to enable fuel to be delivered to a fuel tank in the vehicle. However, the refueling port may only be configured to receive certain types of standardized nozzles, to reduce the likelihood of filling the fuel tank with an improper fuel. Specifically, mis-fueling inhibitors may be provided in refueling ports to inhibit nozzles having certain sizes and/or geometries from being inserted into the refueling ports. Consequently, certain refueling ports may only be able to receive a limited number of refueling nozzles, thereby decreasing the refueling port's applicability. For example, the refueling port may not accept nozzles from a fuel can, preventing a vehicle operator from remotely refueling their vehicle.

JP201276754 discloses a refueling funnel for refueling a vehicle from a portable fuel can. The refueling funnel includes a connecting part which spans the diameter of a filler pipe.

The Inventors have recognized several drawbacks with the refueling funnel disclosed in JP201276754. Firstly, the refueling funnel may build up a large amount of electrostatic charge during refueling. The refueling funnel may be particularly susceptible to electrostatic charge build-up when the flowrate of the fuel through the funnel is high. Moreover, the geometry of the funnel may enable a refueling nozzle to seal against the funnel during refueling, further increasing the build-up of electrostatic charge.

As such in one approach a refueling adapter is provided. The refueling adapter includes a nozzle section and an inlet section coupled to and positioned upstream of the nozzle section, the inlet section including a restrictor element extending across an inlet section flow passage and an anti-sealing rib coupled to an inlet section housing and axially extending across the inlet section flow passage.

The restrictor element increases losses in the adapter, thereby decreasing the flowrate of the fuel through the refueling adapter and decreasing electrostatic charge build-up during refueling. Moreover, the anti-sealing rib reduces the likelihood of a nozzle sealing against the housing of the refueling adapter, further reducing the amount of electrostatic charge build up in the refueling adapter during refueling. As a result, the likelihood of an electric discharge occurring in the fuel which may cause a fire and/or explosion is reduced.

In some examples, the refueling adapter may comprise one or more non-conductive material(s), due to the reduction in electrostatic charge build-up. Consequently, the price of the refueling adapter may be reduced when compared to refueling adapter which may comprise costly conductive materials.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE FIGURES

FIGS. 2-6 are drawn approximately to scale, however other relative dimensions may be used if desired.

DETAILED DESCRIPTION

The present description relates to a refueling adapter which reduces electrostatic charge build-up during refueling through increased losses in the adapter via a restrictor element. A decrease in electrostatic charge build-up during refueling decreases the likelihood of a fire and/or explosion caused by the discharge of the electrostatic charge in the fuel. An anti-sealing rib is also provided in the refueling adapter upstream of the restrictor element. The anti-sealing rib is configured to reduce the likelihood of a nozzle sealing in the adapter, further decreasing electrostatic charge build-up during refueling. The anti sealing rib may also reinforce the flow restrictor so the nozzle user has a reduced chance of breaking the restrictor plate. Due to the decrease in electrostatic charge build-up during refueling the refueling adapter may be constructed out of a non-conductive material, if desired. As a result, the cost of the refueling adapter may be decreased when compared to refueling nozzles constructed out of conductive material.

Figure 1:
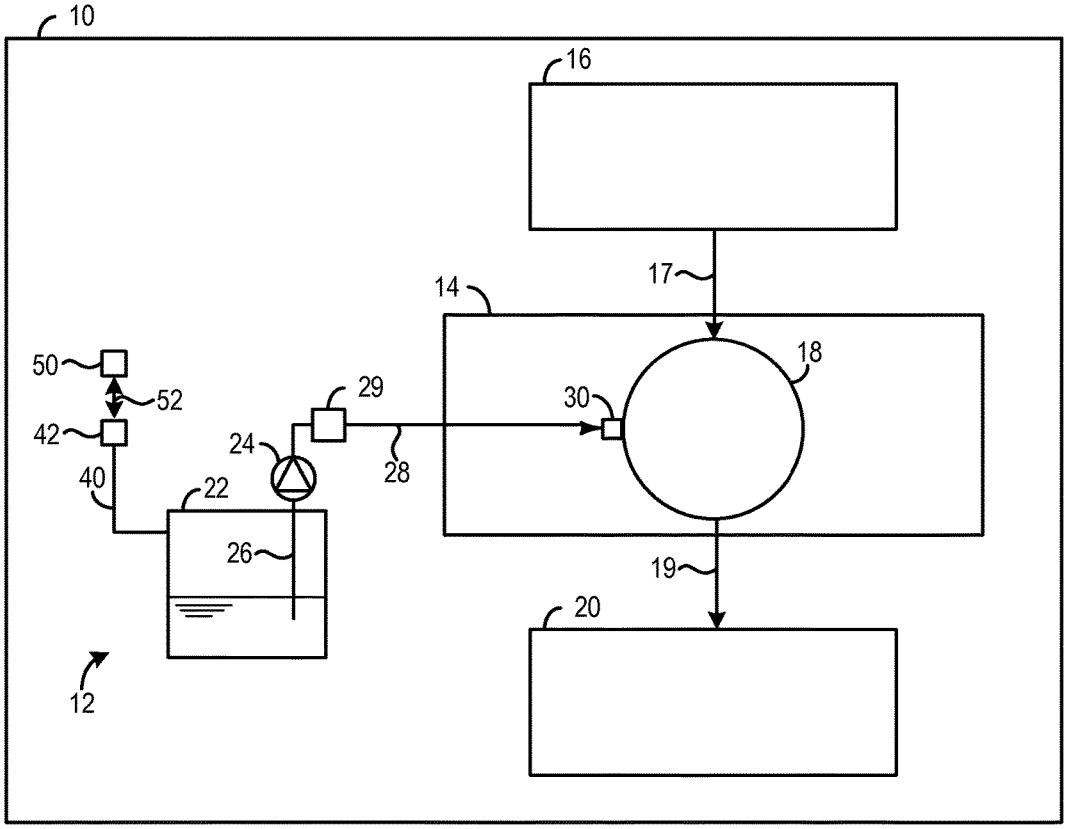
FIG. 1 schematically shows a vehicle including an engine and a fuel delivery system.

FIG. 1 shows a vehicle 10 including a fuel delivery system 12 configured to provide fuel to an engine 14 in the vehicle. An intake system 16 is configured to provide intake air to the engine 14, denote via arrow 17, is also provided in the vehicle 10. The intake system 16 may include a throttle, inlet manifold, intake conduits, etc. The engine 14 is illustrated as having a cylinder 18. However, additional cylinders may be included in the engine, if desired. Combustion operation may be performed in the cylinder 18. The engine 14 may include components configured to facilitate combustion operation implementation. An exhaust system 20 configured to receive exhaust gas from the engine 14 during combustion operation is also provided in the vehicle 10. Specifically, the exhaust system 20 may be in fluidic communication with the cylinder 18, denoted via arrow 19. The exhaust system 20 may include an exhaust manifold, exhaust conduits, emission control devices, etc.

The fuel delivery system 12 includes a fuel tank 22. The fuel delivery system 12 includes a fuel tank 22 configured to store any suitable fuel such as gasoline, diesel, alcohol (e.g., ethanol and methanol), bio-diesel, etc. A fuel pump 24 including a pick-up tube 26 is in fluidic communication with a fuel volume in the fuel tank 22.

A fuel conduit 28 is coupled to an outlet of the fuel pump 24. The fuel delivery system 12 may further include a fuel filter 29 configured to remove unwanted particulates from the fuel flowing through the fuel delivery system. The fuel conduit 28 is in fluidic communication with a fuel injector 30 coupled directly to the cylinder 18 to provide what is known as direct injection to the engine 14. Additionally or alternatively, a port fuel injector, in the fuel delivery system, positioned upstream of the cylinder 18 may be used to provide fuel to the cylinder 18. It will be appreciated that addition components may be included in the fuel delivery system such as a higher pressure fuel pump 24.

A refueling conduit 40 is also included in the fuel delivery system 12. The refueling conduit 40 is in fluidic communication with the fuel tank 22 and a refueling port 42. The refueling port may include a refueling cap, a refueling door, a refueling inlet, etc. In one example, the refueling port includes a cap-less inlet, in which there is no removable cap but rather a spring-loaded covering of the inlet that moves as a result of insertion of an appropriately sized nozzle and/or an adapter as described herein. Thus, the refueling port 42 may be configured to receive a refueling nozzle. The refueling nozzle may be included in a fuel pump in a vehicle filing station, for example. Additionally, the refueling port 42 may include a mis-fueling inhibitor configured to receive nozzles having only certain sizes or geometries. However, in other examples the mis-fueling inhibitor may not be included in the refueling port 42.

Additionally, the refueling port 42 may be configured to receive a refueling adapter 50. Specifically, the refueling adapter may be removably coupled (e.g., attached and removed from) the refueling port 42, denoted via arrow 52. In this way, a user may attach and remove the refueling adapter 50 when desired. In another example, the refueling adapter 50 may be removably coupled to a fuel canister (e.g., a gas can). In this way, the refueling adapter 50 may be used for refueling different fuel storage containers, thereby increasing the refueling adapter's applicability and enabling the vehicle to be refueled at remote locations.

The refueling adapter 50 is configured to enable nozzles of different sizes and/or geometries to be inserted into the refueling port 42, shown in FIG. 1, or another suitable refueling port. The refueling adapter 50 is also configured to reduce the flowrate of the fuel into the refueling port 42 shown in FIG. 1 or any other suitable fuel port. It will be appreciated that in some examples the refueling adapter may be stored in the vehicle 10 such as in a spare tire well in the vehicle, for example. In one example, the refueling adapter 50 may be a non-black color which may enable a vehicle operator to easily distinguish the refueling adapter from spare parts (e.g., a spare tire) and/or spare tools adjacent to the refueling adapter, when stored in the vehicle.

Figure 2:
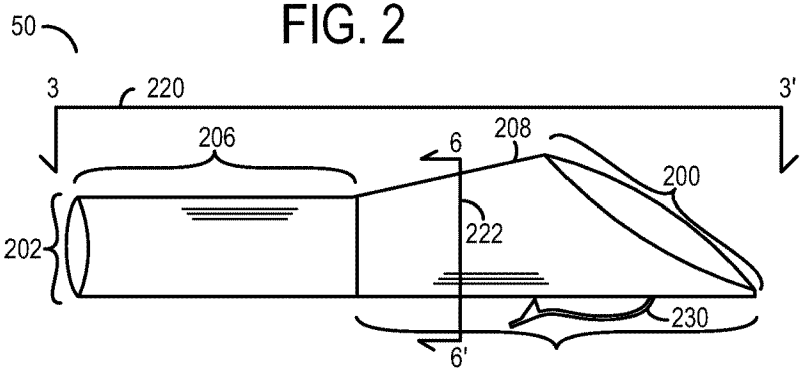
FIG. 2 shows an example refueling adapter.

FIG. 2 shows an example refueling adapter 50. The refueling adapter 50 includes an inlet 200 and an outlet 202. The inlet 200 is configured to receive a refueling nozzle, such as a refueling nozzle included in a fuel pump at a filling station or of a fuel can. The outlet 202 is configured to be inserted into a fuel port, such as the refueling port 42 shown in FIG. 1.

The refueling adapter 50 includes an inlet section 204 and a nozzle section 206. The nozzle section 206 may also be referred to as an outlet section. Additionally, the refueling adapter 50 includes a housing 208. The housing 208 may be conceptually divided into a nozzle section housing and an inlet section housing. The housing 208 may define flow passages in the refueling adapter 50 discussed in greater detail herein. Cutting plane 220 defines the cross-section shown in FIGS. 3-5 denoted by 3-3' and cutting plane 222 defines the cross-section shown in FIG. 6 denoted by 6-6'. The refueling adapter 50 further includes a pen clip 230. The pen clip 230 may be used in some vehicles to hold the refueling adapter (e.g., an upper part of the refueling adapter) in position while in storage in the vehicle, such as in a spare tire well of the vehicle.

Figure 3:
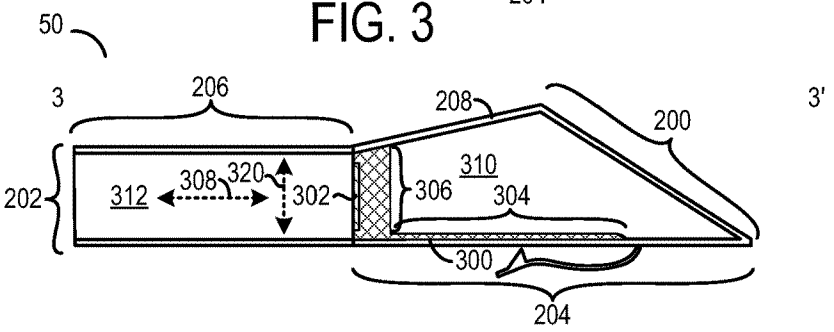
FIG. 3 shows an example cross-sectional view of the refueling adapter illustrated in FIG. 2.
Figure 4:
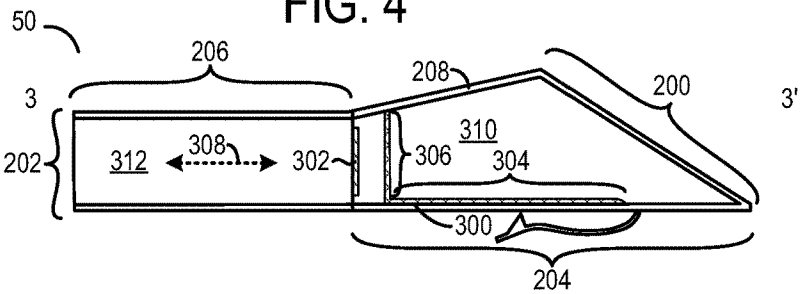
FIG. 4 shows another example cross-sectional view of the refueling adapter illustrated in FIG. 2.

FIGS. 3-4 show cross-sectional views of the refueling adapter 50 shown in FIG. 2. FIG. 3 shows the refueling adapter 50 having the housing 208. The refueling adapter 50 also includes an anti-sealing rib 300 and a restrictor element 302. The anti-sealing rib 300 is coupled (e.g., directly coupled) to the housing 208. The restrictor element 302 may be coupled (e.g., directly coupled) to the anti-sealing rib 300. Additionally, the restrictor element 302 may also be coupled (e.g., directly coupled) to the housing 208.

The housing 208 may be constructed out of a non-conductive material, such as a non-conductive polymeric material (e.g., Polyester, Polypropylene, Polyethylene, Acetal (POM), Acrylonitrile butadiene styrene (ABS), Polycarbonate, Acrylic, Polyphthalamide (PPA), and/or Polyphenylene sulfide (PPS). Thus, the housing 208 may comprise a non-conductive material. The restrictor element 302 may be constructed out of a non-conductive material, such as a non-conductive polymeric material, (e.g., Polyester, Polypropylene, Polyethylene, Acetal (POM), Acrylonitrile butadiene styrene (ABS), Polycarbonate, Acrylic, Polyphthalamide (PPA), and/or Polyphenylene sulfide (PPS). Thus, the restrictor element 302 may comprise a non-conductive material. The anti-sealing rib 300 may be constructed out of a non-conductive material, such as a non-conductive polymeric material, (e.g., Polyester, Polypropylene, Polyethylene, Acetal (POM), Acrylonitrile butadiene styrene (ABS), Polycarbonate, Acrylic, Polyphthalamide (PPA), and/or Polyphenylene sulfide (PPS). Thus, the anti-sealing rib 300 may comprise a non-conductive material. In one example, the refueling adapter 50 may not include a conductive material. In some examples, the housing, anti-sealing rib, and/or restrictor element may comprise different materials. However, in other examples at least two of the housing, anti-sealing rib, and restrictor element may comprise similar material(s).

The anti-sealing rib 300 includes a first portion 304 and a second portion 306. The first portion 304 and the second portion 306 are arranged perpendicular to one another. However, other relative positions of the first portion and the second portion have been contemplated. The first portion 304 extends along and is directly coupled to the inlet section housing. Thus, the first portion radially extends from the housing in an inward direction. As shown, the thickness of the first portion 304 does not vary along its length. However, other anti-sealing rib geometries have been contemplated. For example, the thickness of the first portion 304 may vary along its length. The first portion 304 is parallel to an axis 308 of the nozzle section 206. Additionally, the second portion 306 is radially aligned. A radial axis 320 is also provided for reference.

Thus, the second portion 306 radially extends across the inlet section 204. Specifically, the second portion 306 radially extends across an inlet section flow passage 310. However, other anti-sealing rib geometries have been contemplated.

The housing 208 defines flow passages in the refueling adapter 50. An inlet section flow passage 310 is shown. The boundary of the inlet section flow passage 310 is defined by the inlet section housing 208, the anti-sealing rib 300, and the restrictor element 302. A nozzle section flow passage 312 is also shown in FIG. 3. The boundary of the nozzle section flow passage 312 is defined by the nozzle section housing.

Furthermore, the restrictor element 302 is shown directly coupled to the anti-sealing rib 300, in FIG. 3. Specifically, the restrictor element may be positioned in a recess in the anti-sealing rib 300. However, as shown in FIG. 4 the restrictor element 302 is spaced away (e.g., axially spaced away) from the anti-sealing rib 300. The housing 208 is also shown in FIG. 4. As depicted in FIG. 3, the anti-sealing rib 300 is positioned upstream of the restrictor element 302. Thus, the restrictor element is positioned downstream of the anti-sealing rib. The refueling adapter 50 shown in FIG. 4 includes many components which are comparable. Therefore, similar parts are labeled accordingly.

Returning to FIG. 3, the thickness of the illustrated housing 208 does not vary along its length. However, in other examples, the thickness of the housing 208 may vary along its length. For example, the nozzle section housing may have a greater thickness than the inlet section housing or vice-versa. Further in some examples, the thickness of the housing may vary in the individual housing sections.

Figure 5:
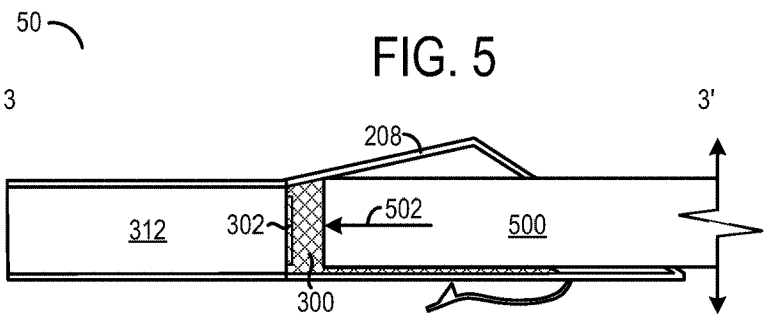
FIG. 5 shows the refueling adapter illustrated in FIG. 2 during refueling operation.

FIG. 5 shows a cross-sectional view of the refueling adapter 50, shown in FIG. 3, with a fuel nozzle 500 inserted therein. The fuel nozzle 500 may be coupled to a fuel pump at a filling station, a fuel can, etc.

Arrow 502 denotes the general flow of fuel from the nozzle 500. Thus, during refueling fuel may flow around the anti-sealing rib 300 and the restrictor element 302 and into the nozzle section flow passage 312. Thus, the restrictor element 302 does not completely block the nozzle section flow passage 312. Impeding the fuel via the restrictor element increases losses in the adapter, thereby decreasing the flowrate of the fuel through the adapter during refueling. It will be appreciated that the fuel may have additional complexity that is not depicted.

As shown, the nozzle 500 is in face sharing contact with the anti-sealing rib 300. The interface between the anti-sealing rib 300 and the nozzle 500 substantially prevents the nozzle from sealing in the refueling adapter 50, thereby reducing the flowrate of fuel and the propensity towards electrostatic charge build-up during refueling in the refueling adapter. Decreasing the electrostatic charge build-up during refueling decreases the likelihood of an electrostatic discharge into the fuel which may cause a fire and/or explosion.

Figure 6:
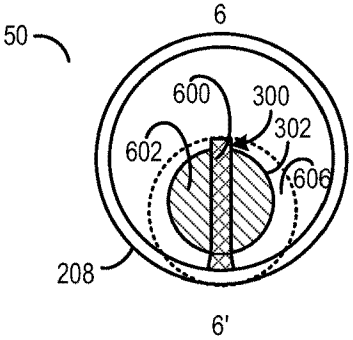
FIG. 6 shows another cross-sectional view of the refueling adapter illustrated in FIG. 2.

FIG. 6 shows another example cross-sectional view of the refueling adapter 50 shown in FIG. 2. The cross-sectional view is oriented in a downstream direction. As shown, the anti-sealing rib 300 is arranged upstream of the restrictor element 302. The restrictor element 302 is circular, in the depicted example. However, other restrictor element geometries have been contemplated. For example, the restrictor plate may include a mesh, molded screen, or grate.

As shown, the anti-sealing rib 300 circumferentially extends around only a portion of the inlet section housing. Moreover, the anti-sealing rib 300 extends in a radial inward direction from a surface of the inlet section housing. Specifically, the anti-sealing rib 300 circumferentially extends 5 degrees or less around the housing 208, in one example. The angle may be selected based on the thickness of the housing.

FIG. 6 shows a flow impeding surface 600 of the anti-sealing rib 300 and a flow impeding surface 602 of the restrictor element 302. The area of surface 600 is less than the area of surface 602. However, other relative sizes have been contemplated. In FIG. 6, the restrictor element 302 is circular. However, other restrictor element geometries have been contemplated. The flow impeding surface 602 is planar and perpendicularly arranged with regard to the axis 308, shown in FIG. 3. However, other flow impeding surface geometries have been contemplated.

In some examples, a ratio between the area of the flow impeding surface 600 and an unrestricted flow plane 606 peripheral to the restricted surface area may be selected to achieve a flowrate of ≤1.5 gallons per minute through the refueling adapter during refueling operation. The cross-sectional views illustrate the various openings and free space included in the adapter structure.

Figure 7:
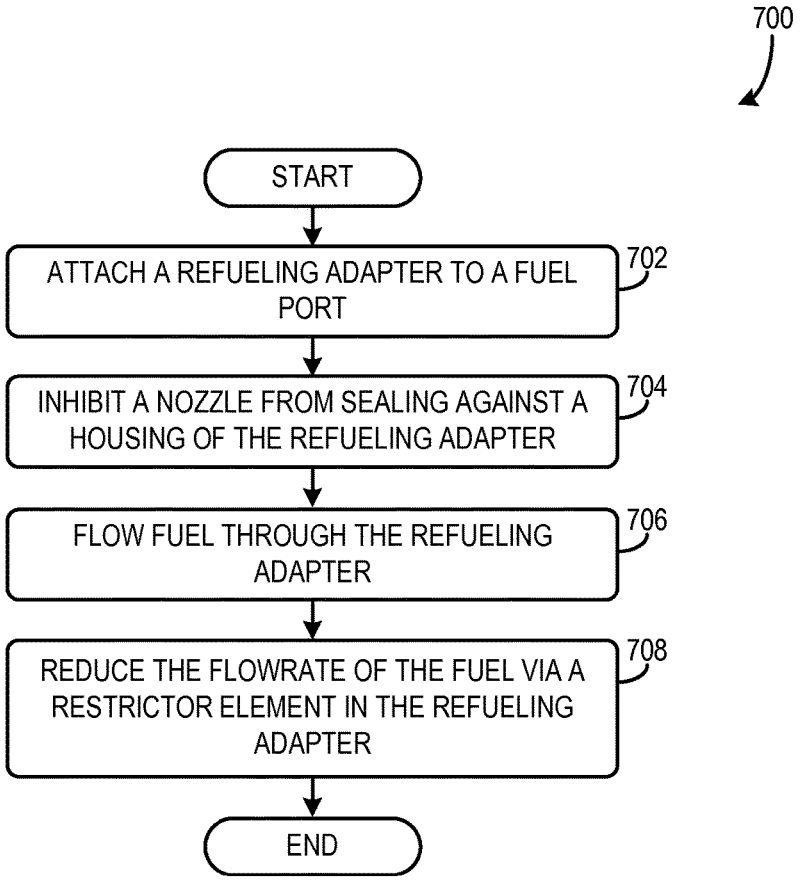
FIG. 7 shows a method for operation of a refueling adapter.

FIG. 7 shows a method 700 for operation of a refueling adapter. The method 700 may be implemented via the refueling adapter discussed above with regard to FIGS. 1-6 or may be implemented via another suitable refueling adapter in other examples.

At 702 the method includes attaching a refueling adapter to a fuel port. Next at 704 the method includes inhibiting a nozzle from sealing against a housing of the refueling adapter.

At 706 the method includes flowing fuel through the refueling adapter. Next at 708 the method includes reducing the flowrate of the fuel via a restrictor element in the refueling adapter.

Note that the example control routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. Further, one or more of the various system configurations may be used in combination with one or more of the described methods. The subject matter of the present disclosure includes all novel and non-obvious combinations and sub-combinations of the various systems and configurations, and other features, functions, and/or properties disclosed herein.

The invention claimed is:

1. A refueling adapter comprising:

a nozzle section; and an inlet section coupled to and positioned upstream of the nozzle section, the inlet section including a restrictor element extending across an inlet section flow passage and an anti-sealing rib coupled to an inlet section housing and axially extending along the inlet section flow passage, where the nozzle section removably engages with a cap-less refueling port, and where the anti-sealing rib is axially spaced away from the restrictor element, where the anti-sealing rib is positioned upstream of the restrictor element, where the refueling adapter does not include a conductive material, where the restrictor element is circular, where the restrictor element is positioned perpendicular to an axis of the nozzle section, where the restrictor element includes a mesh, screen, or grate, where the refueling adapter is a non-black color, and where a diameter of the restrictor element is less than a diameter of the nozzle section of the refueling adapter, the restrictor element forming flow passages between an outside edge of the restrictor element and the nozzle section.

2. The refueling adapter of claim 1, where at least one of the restrictor element and the anti-sealing rib comprises a non-conductive material, and wherein the restrictor element extending across the inlet section flow passage does not completely block the inlet section flow passage.

3. The refueling adapter of claim 2, where the non-conductive material comprises a non-conductive polymeric material, where the inlet section comprises a frustoconical section of the non-conductive material, and where the nozzle section comprises a cylindrical section of the non-conductive material.

4. The refueling adapter of claim 1, where the anti-sealing rib circumferentially extends around only a portion of the inlet section housing and extends in a radial inward direction from a surface of the inlet section housing, and where the anti-sealing rib is directly coupled to the restrictor element.

5. The refueling adapter of claim 1, where a boundary of the inlet section flow passage is defined by the inlet section housing and the anti-sealing rib, and where an area of a flow impeding surface of the anti-sealing rib is less than an area of a flow impeding surface of the restrictor element.

6. A system, comprising:

a vehicle having a cap-less refueling port; and a refueling adapter removably engaging the cap-less refueling port, the refueling adapter comprising: a nozzle section and an inlet section coupled to and positioned upstream of the nozzle section, the inlet section including a restrictor element extending across an inlet section flow passage and an anti-sealing rib coupled to an inlet section housing, the cap-less refueling port configured to receive the refueling adapter, wherein the anti-sealing rib includes a first and a second portion, the first portion extending along an interior of the inlet section in an axial direction, the second portion extending across the inlet section in a radial direction, and the second portion directly coupled to the restrictor element.

7. The system of claim 6, where at least one of the restrictor element and the anti-sealing rib of the refueling adapter comprises a non-conductive material, wherein the restrictor element extending across the inlet section flow passage does not completely block the inlet section flow passage.

8. The system of claim 7, where the non-conductive material comprises a non-conductive polymeric material, and where the inlet section comprises a frustoconical section of the non-conductive material, and where the nozzle section comprises a cylindrical section of the non-conductive material.

9. The system of claim 8, where the refueling adapter does not include a conductive material.

10. The system of claim 6, where the anti-sealing rib circumferentially extends around only a portion of the inlet section housing and extends in a radial inward direction from a surface of the inlet section housing.

11. The system of claim 10, where the restrictor element includes a planar surface perpendicularly arranged with regard to an axis of the nozzle section.

12. The system of claim 10, where the anti-sealing rib is positioned upstream of the restrictor element, and the restrictor element is configured to decrease a flow rate.

13. The system of claim 12, where a boundary of the inlet section flow passage is defined by the inlet section housing and the anti-sealing rib, and the first and second portions of the anti-sealing rib are arranged perpendicularly to each other.

14. The system of claim 12, where an area of a flow impeding surface of the anti-sealing rib is less than an area of a flow impeding surface of the restrictor element.

15. The system of claim 6, where the anti-sealing rib is spaced away from the restrictor element in the axial direction.

16. The system of claim 6, where the restrictor element is circular, and a thickness of the inlet section housing does not vary along its length.

17. The system of claim 6, where the restrictor element is positioned perpendicular to an axis of the nozzle section.

18. The system of claim 6, where the restrictor element includes a mesh, screen, or grate.

19. The system of claim 6, where the refueling adapter is a non-black color and includes a pen clip coupled to the inlet section housing.

* * * * *